United States Patent [19]

Gracie

[11] 4,407,497

[45] Oct. 4, 1983

[54] WEIGHTED EXERCISE SUIT

[76] Inventor: Geysa Gracie, P.O. Box A, Alderson, W. Va. 24910

[21] Appl. No.: 335,359

[22] Filed: Dec. 29, 1981

[51] Int. Cl.[3] ..... A63B 21/12

[52] U.S. Cl. ..... 272/119; 128/DIG. 15; 2/67

[58] Field of Search ..... 272/119, 71, 93; 2/67, 2/2.1 R; 128/DIG. 15

[56] References Cited

U.S. PATENT DOCUMENTS

| | | | |
|---|---|---|---|
| 3,436,762 | 4/1969 | Cahan | 2/67 |
| 3,525,141 | 8/1970 | Smith | 272/119 X |
| 4,239,211 | 12/1980 | Wilkerson | 272/119 |
| 4,268,917 | 5/1981 | Massey | 272/119 X |

*Primary Examiner*—Richard C. Pinkham
*Assistant Examiner*—William R. Browne
*Attorney, Agent, or Firm*—Lane, Aitken & Kananen

[57] ABSTRACT

A weighted exercise suit designed to enable human users to exercise with added weights removably attached to a body suit. Specifically, it is designed incorporating two weight strips that are removably attached to the suit over the shoulders. Each strip contains separate compartments which hold weights, the amount of which is regulated by the user. Furthermore, the suit is designed to provide for a balanced and symmetrical distribution of weight from front to back and from side to side over the upper body, rather than having the weight placed solely on the lower body as in the prior art weighted belts.

14 Claims, 6 Drawing Figures

WEIGHTED EXERCISE SUIT

BACKGROUND OF THE INVENTION (1) Field of the Invention

The invention is in the field of exercise devices. More particularly, the invention is a weighted exercise suit.

(2) Description of the Prior Art

U.S. Pat. No. 1,291,465 to Foreman teaches a training weight consisting of a receptacle of semi-spherical shape. The receptacle is designed to contain a variable amount of material, such as liquid or shot, so that the weight of the receptacle may be regulated to suit the individual requirements of the user. The weight is made in an oval elliptical form with a concave portion extending longitudinally of the base so that the weight may be positioned longitudinally on a person's shoulder.

U.S. Pat. No. 3,322,425 to Moore teaches a weight lifting exercise device to be placed on the shoulders of a weight lifter's body. The device comprises a rigid metal shoulder frame which consists of a rectangular bar bell support frame having four sides constructed from metal straps which may be adjustable and having mounted thereon on opposite sides thereof a protruding bar bell shaft constructed from metal and welded to the frame.

U.S. Pat. No. 3,427,020 to Montour et al discloses leg weights having removable granular weight filled bags.

U.S. Pat. No. 3,532,339 to Smith teaches a flexible weighted belt having a plurality of small weights disposed within the sections of the belt.

U.S. Pat. No. 3,759,510 to Jackson discloses an exercise garment including a helmet, jacket, armlets, gloves, belt, shorts, thigh leggings, calf leggings and boots.

U.S. Pat. No. 4,247,097 to Schwartz teaches a variable weight aerobic exercise glove. The relevance of Schwartz resides in the fact that a Velcro fastener is used to hold the glove in place on the hand and a Velcro fastener is used to secure a flap cover which in turn holds an interchangeable bag of weight particles, such as fine lead shot.

Finally, U.S. Pat. No. 4,268,917 to Massey discloses a variably weighted vest for use in exercise activities such as jogging, skating, bicycling, and horseback riding. The vest is provided with a plurality of pockets for receiving a weight material such as sand, pebbles, and small stones which provide the desired weight. The weights may be installed in the front and in the back.

SUMMARY OF THE INVENTION

One embodiment of the invention is a weighted exercise suit for a human user, comprising:

(a) a body suit means for covering at least the upper portion of the body trunk of the human user;

(b) two weight strip means for adding weight to the upper portion of the body trunk of the human user, the weight strip means being designed to be placed over and removably fastened to selected places on the body suit means, the selected places on the body suit being located over the right and left shoulders of the human user and extending from front to back;

(c) cushion means for cushioning the weight of the weight strips, the cushion means being attached to the lower face of the weight strips; and, (d) fastening means for removably fastening the weight strip means to the selected places on the body suit means located over the right and left shoulders of the human user and extending from front to back, the fastening means comprising:

(1) a first component attached to the lower face of the cushion means; and, (2) a second component attached to the upper face of the selected places on the body suit means located over the right and left shoulders of the human user, whereby the weight strip means may be removably fastened to the selected places on the body suit means located over the right and left shoulders of the user and extending from front to back.

Another embodiment of the invention is a weighted exercise suit for a human user, comprising:

(a) a body suit means for covering at least the upper portion of the body trunk of the human user;

(b) two weight strip means for adding weight to the upper portion of the body trunk of the human user, the weight strip means being designed to be placed over and removably fastened to selected places on the body suit means, the selected places on the body suit being located over the right and left shoulders of the human user and extending from front to back;

(c) cushion means for cushioning the weight of the weight strips, the cushion means being attached to the upper face of the selected places on the body suit means located over the right and left shoulders of the human user and extending from front to back; and (d) fastening means for removably fastening the weight strip means to the selected places on the body suit means over the right and left shoulders of the human user and extending from front to back, the fastening means comprising:

(1) a first component attached to the lower face of the weight strip means; and, (2) a second component attached to the upper face of said cushion means attached to the selected portions of the body suit means located over the right and left shoulders of the human user, whereby the weight strip means may be removably fastened to the selected places on the body suit means located over the right and left shoulders of the user and extending from front to back.

DESCRIPTION OF THE PREFERRED EMBODIMENTS

The invention is a weighted exercise suit designed to enable human users, such as athletes, to exercise with added weights removably attached to a body suit. Specifically, it is designed incorporating two weight strips that are removably attached to the suit over the shoulders. Each strip contains separate compartments which hold weights, the amount of which is regulated by the user. Furthermore, the suit is designed to provide for a balanced and symmetrical distribution of weight from front to back and from side to side over the upper body trunk rather than having the weight placed solely on the lower body as in the prior art weighted belts.

Figure 1:
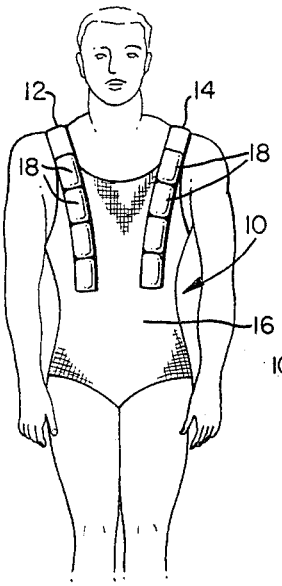
FIG. 1 is a front view of one version of the weighted exercise suit designed for a male human, wherein the two weight strips extend to the male's waist in front.
Figure 2:
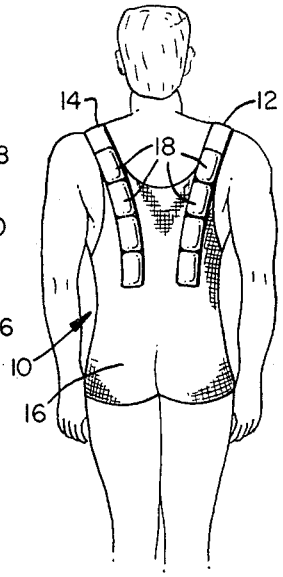
FIG. 2 is a back view of the same version (as FIG. 1) of the weighted exercise suit designed for a male human, wherein the two weight strips extend to the male's waist in back.

Referring to FIGS. 1 and 2 of the drawings, reference numeral 10 refers in general to a weighted exercise suit designed for a male human wherein the two weight strips 12 and 14 extend to the male's waist in front and in back.

The weighted exercise suit 10 includes the two weight strips 12 and 14, and a body suit 16 which covers at least the upper portion of the body trunk of the human user. The weight strips 12 and 14 are removably attached to the body suit 16 at selected places which are located over the right and left shoulders of the human user and which extend from front to back. In the male version of the weighted exercise suit shown in FIGS. 1 and 2, the weight strips 12 and 14 may extend to the waist in the front and to the waist in the back. It is one of the principles of the invention that the weight be evenly and symmetrically distributed from front to back and from side to side.

The weight strips 12 and 14 may be weight belts made of any suitable material such as vinyl plastic, canvas cloth, and the like. As illustrated in FIGS. 1 and 2, they may be constructed with separate pouch-like weight compartments 18. The compartments may have a flap which may be opened and closed for the purpose of inserting and withdrawing separate weights.

The weights in the weight compartments 18 may be made of any suitable material such as rectangular-shaped lead wafers, lead shot, stones, and the like. The human user can vary the amount of weight according to the user's desire by adding more weight to the weight compartments or by removing weight from them.

The body suit 16 covers at least the upper portion of the body trunk of the human user. In a preferred embodiment as shown in FIGS. 1 and 2, the body suit 16 is similar to a one-piece bathing suit with no arms or legs. This type of body suit is designed to fit closely yet comfortably to the body, making it appropriate for any type of exercise while the user is wearing the weighted exercise suit. Optionally, a body suit having arms and legs may be employed.

The body suit 16 may be made of a stretchable elastic textile material such as a lightweight spandex material and the like.

Figure 3:
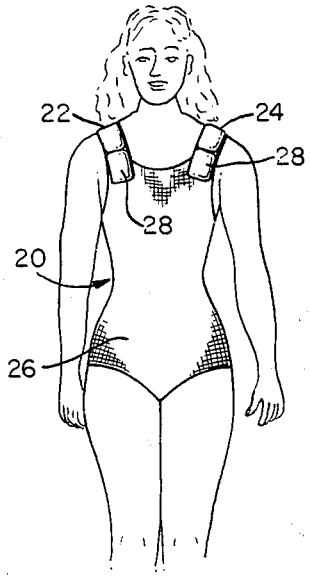
FIG. 3 is a front view of another version of the weighted exercise suit designed for a female human, wherein the two weight strips are shorter in length in the front (as compared to the male version shown in FIGS. 1 and 2). In this female version, the emphasis of the weight is on the shoulders.
Figure 4:
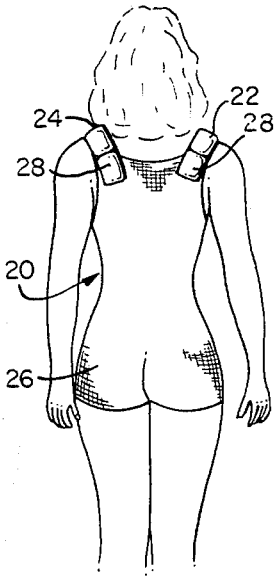
FIG. 4 is a back view of the same version (as in FIG. 3) of the weighted exercise suit designed for a female human, wherein the two weight strips are shorter in length in the back (as compared to the embodiment shown in FIGS. 1 and 2). Again, in this female version, the emphasis of the weight is on the shoulders.

Referring to FIGS. 3 and 4, reference numeral 20 refers to a version of the weighted exercise suit designed for a female human wherein the two weight strips 22 and 24 are shorter in length as compared to the male version shown in FIGS. 1 and 2. In this female version, the emphasis of the weight is on the shoulders and the weights do not extend over the bustline in front or down to the waist in back.

The weighted exercise suit 20 includes the two weight strips 22 and 24, and a body suit 26 which covers at least the upper portion of the body trunk of the human user. The weight strips 22 and 24 are removably attached to the body suit 26 at selected places which are located over the right and left shoulders of the human user and which extend from front to back. Again, it is one of the principles of the invention that the weight be evenly and symmetrically distributed from front to back and from side to side.

The weight strips 22 and 24 may be weight belts made of any suitable durable flexible material such as vinyl plastic, canvas, cloth, and the like. As illustrated in FIGS. 3 and 4, they may be constructed with separate pouch-like weight compartments 28. The compartments may have a flap which may be opened and closed for the purpose of inserting and withdrawing weights.

The weights in the weight compartments 28 may be made of any suitable material such as rectangular-shaped lead wafers, lead shot, stones, and the like. The human user can vary the amount of weight according to the user's desire by adding more weight to the weight compartments or by removing weight from them.

The body suit 26 covers at least the upper portion of the body trunk of the human user. In a preferred embodiment as shown in FIGS. 3 and 4, the body suit 26 is similar to a one-piece bathing suit with no arms or legs. This type of body suit is designed to fit closely yet comfortably to the body making it appropriate for any type of exercise while the user is wearing the weighted exercise suit. Optionally, a body suit having arms and legs may be employed.

As in the male version, the body suit 26 may be made of a stretchable elastic textile material such as light weight spandex material and the like.

Figure 5:
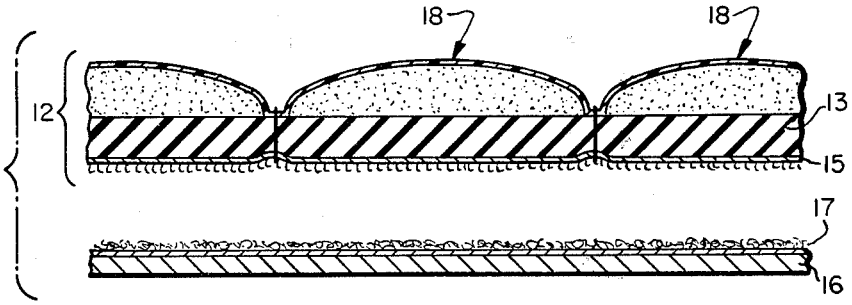
FIG. 5 is a vertical cross-sectional view of one embodiment of the invention taken along the longitudinal axis of a weight strip. The figure shows the relationship of the weight strip, the cushion means, the fastening means, and the body suit material. In this embodiment, the cushion means is attached to the lower face of the weight strip.

Referring to FIG. 5, the drawing shows a vertical cross-sectional view of a preferred embodiment for the construction of the weighted exercise suit of either FIGS. 1–2 or FIGS. 3–4. In this embodiment, the weight strip 12 has a cushion layer 13 attached to the lower face of the pouch-like weight compartments 18.

The purpose of the cushion layer 13 is to absorb the impact or shock of the weights when the human user is wearing the suit and exercising vigorously. The cushion layer 13 can be made of any suitable material such as foam rubber, cotton padding, captured air cells, and the like. The cushion layer 13 may preferably be enclosed within a cover or envelope of the same durable flexible material used to make the weight compartments 18 such as vinyl plastic, canvas, cloth, and the like. Any desired bonding method, such as sewing, adhesives, and similar processes, may be used to attach the cushion layer 13 to the weight compartments 18.

A means is provided for removably fastening the weight strip 12 to the body suit 16. One of the preferred fastening means is shown in FIG. 5 where Velcro fastener material is employed. The spiny layer 15 of the Velcro fastener is attached to the lower face of the cushion layer 13 and the corresponding fuzzy layer 17 of the Velcro is attached at the selected places on the upper face of the body suit 16. Any desired bonding method, such as sewing, adhesives, and similar processes, may be used to attach the spiny layer 15 to the lower face of the cushion layer 13. In this way, the weight strip 12 may be removably attached to the body suit 16 at the selected places over each shoulder of the user and extending from front to back.

The user can put on the body suit 16, then place the weight strips 12 and 14 over the locations having the fuzzy portion 17 of the Velcro fastener. When the user has completed the exercise program, the weight strips 12 and 14 are removed from the body suit 16. Then the user can take off the body suit 16, which may then be separately washed or cleaned, as desired.

Figure 6:
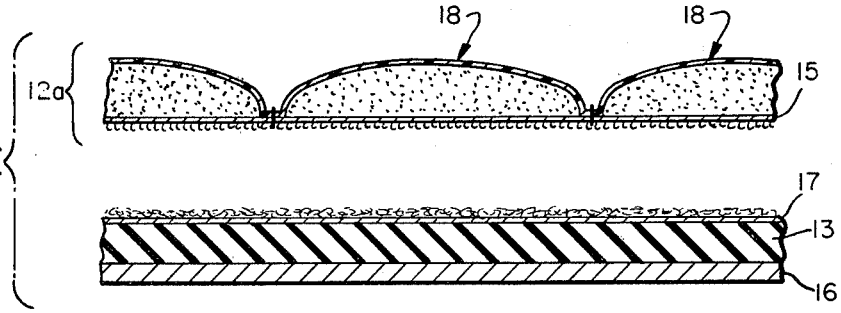
FIG. 6 is a vertical cross-sectional view of another embodiment of the invention taken along the longitudinal axis of a weight strip. The figure shows the relationship of the weight strip, the fastening means, the cushion means, and the body suit material. In this embodiment, the cushion means is attached to the upper face of the body suit material.

Referring to FIG. 6, the drawing shows a vertical cross-sectional view of an alternative embodiment for the construction of the weighted exercise suit of either FIGS. 1–2 or FIGS. 3–4. In this alternative embodiment, the weight strip 12*a* has the spiny layer 15 of the Velcro fastener material attached to the lower face of the pouch-like weight compartments 18 and the cushion layer 13 is attached at the selected places on the upper face of the body suit 16. Any desired bonding method can be employed to attach the spiny layer 15 to the lower face of the weight compartments 18.

The corresponding fuzzy layer 17 of the Velcro fastener is attached to the upper face of the cushion layer 13. As before, the cushion layer 13 can be made of any suitable material such as foam rubber, cotton padding, captured air cells, and the like. The cushion layer 13 may preferably be enclosed within a cover or envelope of a suitable durable flexible material, such as vinyl plastic, canvas, cloth, and the like. Any desired bonding method, such as sewing, adhesives, and similar processes, may be used to attach the cushion layer 13 at the selected places on the upper face of the body suit 16 and to attach the fuzzy layer 17 to the upper face of the cushion layer 13.

Comparing the embodiment shown in FIG. 5 with the embodiment shown in FIG. 6, it is believed that the FIG. 5 embodiment may prove to be more durable in actual use. This is because the cushion layer 13 is not attached to the body suit 16, and thus, the cushion layer 13 in the FIG. 5 embodiment will not need to be subjected to the wear and tear of a washing every time the body suit is washed in a clothes washing machine.

The above-described embodiments are intended to be illustrative, not restrictive. The full scope of the invention is defined by the claims, and any and all equivalents are intended to be embraced.

I claim:

1. A weighted exercise suit for a human user, comprising:

(a) a body suit means for covering at least the upper portion of the body trunk of the human user;

(b) two weight strip means for adding weight to the upper portion of the body trunk of the human user, said weight strip means being designed to be placed over and removably fastened to selected places on said body suit means, said selected places on said body suit being located over the right and left shoulders of the human user and extending from front to back;

(c) cushion means for cushioning the weight of said weight strips, said cushion means being attached to the lower face of said weight strip; and, (d) fastening means for removably fastening said weight strip means to said selected places on said body suit means located over the right and left shoulders of the human user and extending from front to back, said fastening means comprising:

(1) a first component attached to the lower face of said cushion means; and, (2) a second component attached to the upper face of said selected places on said body suit means located over the right and left shoulders of the human user and extending from front to back, whereby said weight strip means may be removably fastened to said selected places on said body suit means located over the right and left shoulders of the user and extending from front to back.

2. The weighted exercise suit defined in claim 1 wherein the body suit means is made of a stretchable elastic material.

3. The weighted exercise suit defined in claim 1 wherein the body suit means is made of spandex.

4. The weighted exercise suit defined in claim 1 wherein the two weight strip means each comprise a weight belt having separate pouch-like compartments which may be opened and closed and into which may be placed variable amounts of weights.

5. The weighted exercise suit defined in claim 1 wherein the two weight strip means each comprise a weight belt made of vinyl plastic material and having separate pouch-like compartments which may be opened and closed and which are designed to contain a variable number of rectangular-shaped wafer weights.

6. The weighted exercise suit defined in claim 1 wherein the cushion means is a layer of foam rubber.

7. The weighted exercise suit defined in claim 1 wherein the fastening means is Velcro fastener material.

8. A weighted exercise suit for a human user, comprising:

(a) a body suit means for covering at least the upper portion of the body trunk of the human user;

(b) two weight strip means for adding weight to the upper portion of the body trunk of the human user, said weight strip means being designed to be placed over and removably fastened to selected places on said body suit means, said selected places on said body suit being located over the right and left shoulders of the human user and extending from front to back;

(c) cushion means for cushioning the weight of said weight strips, said cushion means being attached to the upper face of said selected places on said body suit means located over the right and left shoulders of the human user and extending from front to back; and, (d) fastening means for removably fastening said weight strip means to said selected places on said body suit means located over the right and left shoulders of the human user and extending from front to back, said fastening means comprising:

(1) a first component attached to the lower face of said weight strip means; and, (2) a second component attached to the upper face of said cushion means attached to said selected places on said body suit means located over the right and left shoulders of the human user and extending from front to back, whereby said weight strip means may be removably fastened to said selected places on said body suit means located over the right and left shoulders of the user and extending from front to back.

9. The weighted exercise suit defined in claim 8 wherein the body suit means is made of a stretchable elastic material.

10. The weighted exercise suit defined in claim 8 wherein the body suit means is made of spandex.

11. The weighted exercise suit defined in claim 8 wherein the two weight strip means each comprise a weight belt having separate pouch-like compartments which may be opened and closed and into which may placed variable amounts of weight.

12. The weighted exercise suit defined in claim 8 wherein the two weight strip means each comprise a weight belt made of vinyl plastic material and having separate pouch-like compartments which may be opened and closed and which are designed to contain a variable number of rectangular-shaped wafer weights.

13. The weighted exercise suit defined in claim 8 wherein the cushion means is a layer of foam rubber.

14. The weighted exercise suit defined in claim 8 wherein the fastening means is Velcro fastener material.

* * * * *